US008186543B1

(12) United States Patent
Hopwood

(10) Patent No.: US 8,186,543 B1
(45) Date of Patent: May 29, 2012

(54) AUTOMATED TOOTHPICK DISPENSER

(76) Inventor: Richard E. Hopwood, Fort Worth, TX (US)

( * ) Notice: Subject to any disclaimer, the term of this patent is extended or adjusted under 35 U.S.C. 154(b) by 0 days.

(21) Appl. No.: 13/267,631

(22) Filed: Oct. 6, 2011

Related U.S. Application Data

(63) Continuation of application No. 12/402,552, filed on Mar. 12, 2009, now Pat. No. 8,042,707.

(51) Int. Cl.
*B65D 83/02* (2006.01)

(52) U.S. Cl. ..... 221/192; 221/13

(58) Field of Classification Search ..... 221/13, 221/191, 192
See application file for complete search history.

(56) References Cited

U.S. PATENT DOCUMENTS 1,034,318 A * 7/1912 Sobretto et al. ..... 221/192
1,916,974 A * 7/1933 Fuller et al. ..... 221/15
3,982,660 A * 9/1976 Hashimoto ..... 221/190
4,522,314 A * 6/1985 Nelson ..... 221/190
4,887,737 A * 12/1989 Adenau ..... 221/3
5,097,981 A 3/1992 Degasperi et al.
5,318,200 A * 6/1994 Allen et al. ..... 221/192
5,452,832 A * 9/1995 Niada ..... 225/11

OTHER PUBLICATIONS

Office Action from corresponding parent U.S. Appl. No. 12/402,552 dated Apr. 4, 2011.

* cited by examiner

*Primary Examiner* — Patrick Mackey
(74) *Attorney, Agent, or Firm* — James E. Walton; Richard G. Eldredge

(57) ABSTRACT

A automated toothpick dispenser includes a chamber for carrying a plurality of toothpicks and a lift system for dispensing a single toothpick to a position outside the dispenser. A drive system is coupled to the lift system and is activated by a sensor that detects the presence of a user.

15 Claims, 6 Drawing Sheets

AUTOMATED TOOTHPICK DISPENSER

CROSS REFERENCE TO RELATED APPLICATIONS

This application is a continuation of U.S. application Ser. No. 12/402,552, filed 12 Mar. 2009, titled "Automated Toothpick Dispenser," which is hereby incorporated by reference for all purposes as if fully set forth herein.

BACKGROUND

1. Field of the Invention

The present invention relates to toothpick dispensers, and more particularly, to automated sanitary toothpick dispensers.

2. Description of Related Art

Toothpick dispensers have been around for many years. For example, FIG. 1 shows a cutout, side view of a conventional toothpick dispenser 100. Dispenser 100 includes a housing 104 that carries a plurality of toothpicks 102. Top lid 106 pivotally attaches to joint 108 for pivotally rotation about arc A. A user may pivotally rotate lid 106 for restocking toothpicks 102 within housing 104. The user pushes a slide member 110 for retrieving toothpick 102, as shown with arrow B. Slide member 110 attaches to a spring 114 and includes a delivery slot 112 for placement of toothpick 102.

Dispenser 100 is one of many known dispensers. The known dispensers share a common problem, i.e., the dispensers and toothpicks within the dispensers typically are contaminated with the germs from multiple users. For example, dispenser 100 provides means wherein the user could open lid 106, reach into housing 104, and grab several toothpicks 102. As a result, the user contaminates unused toothpicks 102 and exposes the outside surface of dispenser 100 with germs.

Other types of toothpick dispensers use individually wrapped toothpicks. These embodiments create additional problems, such as increased manufacturing costs and litter caused by users failing to properly dispose of the paper wrappers.

Although great strides have been made in the are of toothpick dispensers, considerable shortcomings remain.

DESCRIPTION OF THE DRAWINGS

The novel features believed characteristic of the invention are set forth in the appended claims. However, the invention itself, as well as a preferred mode of use, and further objectives and advantages thereof, will best be understood by reference to the following detailed description when read in conjunction with the accompanying drawings, wherein:

DETAILED DESCRIPTION OF THE PREFERRED EMBODIMENT

The automated toothpick dispenser of the present application overcomes the disadvantages of conventional toothpick dispensers. Illustrative embodiments are described below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 1:
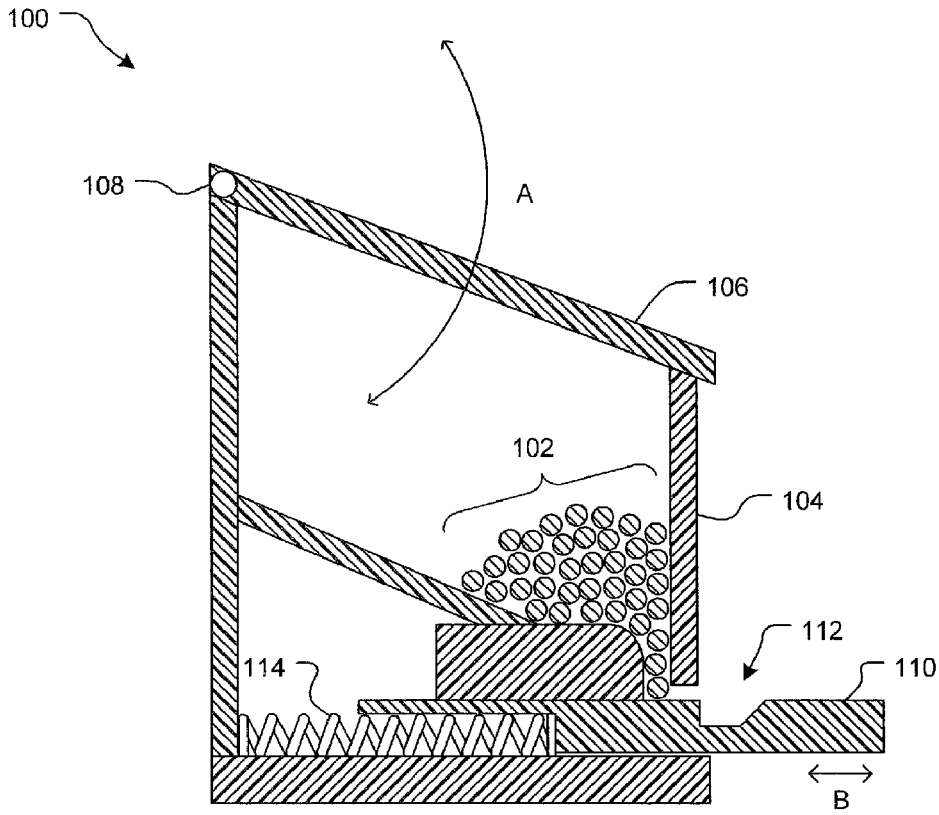
Fig. 1 (Prior Art)
FIG. 1 is a side cross-sectional view of a conventional toothpick dispenser.
Figure 2:
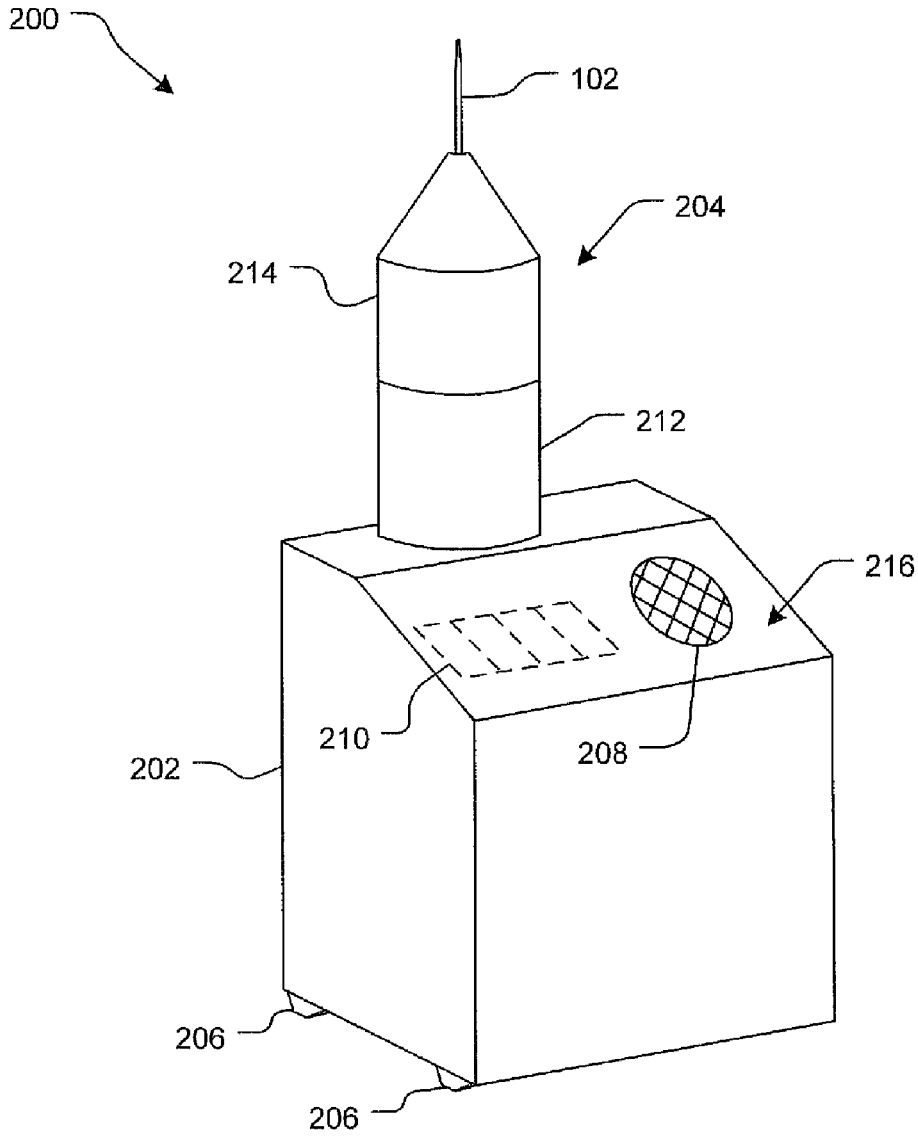
FIG. 2 is an oblique view of the preferred embodiment of an automated toothpick dispenser according to the present application.

Referring to FIG. 2 in the drawings, an oblique view of the preferred embodiment of an automated toothpick dispenser 200 according to the present application is illustrated. Dispenser 200 includes a housing 202 and a chamber 204 releasably coupled to housing 202. Housing 202 houses and supports various components for the operation of dispenser 200. Housing 202 may optionally include one or more footings 206 to support housing 202, prevent housing 202 from slipping, and to provide vibration isolation, if desirable. Chamber 204 is configured to store a plurality of toothpicks 102, and includes a first chamber portion 212 and a second chamber portion 214. A used herein, first chamber portion 212 may also be referred to as lower chamber portion 212, and second chamber portion 214 may also be referred to as upper chamber portion 214. In addition, as explained in more detail below, chamber 204 is also configured to dispense a single toothpick 102 during operation of dispenser 200.

Dispenser 200 preferably includes one or more sensors 208 for sensing the presence of a user. In the preferred embodiment, sensor 208 is a motion sensor that detects when a user's hand or finger passes near housing 202. However, it will be appreciated that sensor 208 may be any of a wide variety of sensors, including motion detectors, proximity sensors, heat sensors, infrared sensors, or any other suitable type of sensor. In an alternative embodiment, sensor 208 may be replaced or augmented by a switch, activation button, or lever.

In addition, dispenser 200 preferably includes an automated electrical system powered by an electrical power source 700 (see FIG. 7), such as a DC battery or DC battery pack. However, it will be appreciated that dispenser 200 may be powered by other means, such as a rechargeable electrical system, in which case, an optional solar energy system, represented by a solar collector 210 and a recharging system 708 (see FIG. 7), may be used to partially or totally recharge the rechargeable electrical power source. In such alternative embodiments, the rechargeable electrical power source could be one or more rechargeable batteries, one or more rechargeable battery packs, or any other suitable rechargeable electrical power source. Other means for powering dispenser 200 and/or recharging the rechargeable electrical power source include the use of interchangeable battery packs, and the use of an AC power source, such as a wall outlet. In those embodiments in which dispenser 200 is connected to a high-voltage AC power source, it may be desirable to utilize a Voltage regulator and/or an AC/DC power converter or transformer.

In the preferred embodiment, housing 202 is rectangular in shape; however, it should be understood that housing 202 and/or chamber 204 may be configured in many different shapes and sizes, including fanciful or collectible shapes, such as animal shapes, monument shapes, and shapes of various inanimate objects. In addition, although chamber 204 has been shown as protruding from the top of housing 202, it will be appreciated that chamber 204 may be partially or totally recessed or contained within housing 202. In addition, although sensor 208 and optional solar collector 210 have been shown positioned on a top surface 216 of housing 202, it should be understood that sensor 208 and optional solar collector 210 may be located at various locations on housing 202 or chamber 204.

Dispenser 200 is operable between a retracted mode, in which toothpicks 102 remain contained within chamber 204, and an extended mode, in which a single toothpick 102 is at least partially exposed outside of chamber 204. It is preferred that dispenser 200 remain in the retracted mode when not in use. This prevents toothpicks 102 from being exposed to contaminants. As explained in detail herein, when a user passes his hand or finger near sensor 208, sensor 208 causes dispenser 200 to transition into the extended mode, thereby causing a single toothpick 102 to be partially or fully extended beyond chamber 204 and housing 202.

Figure 4:
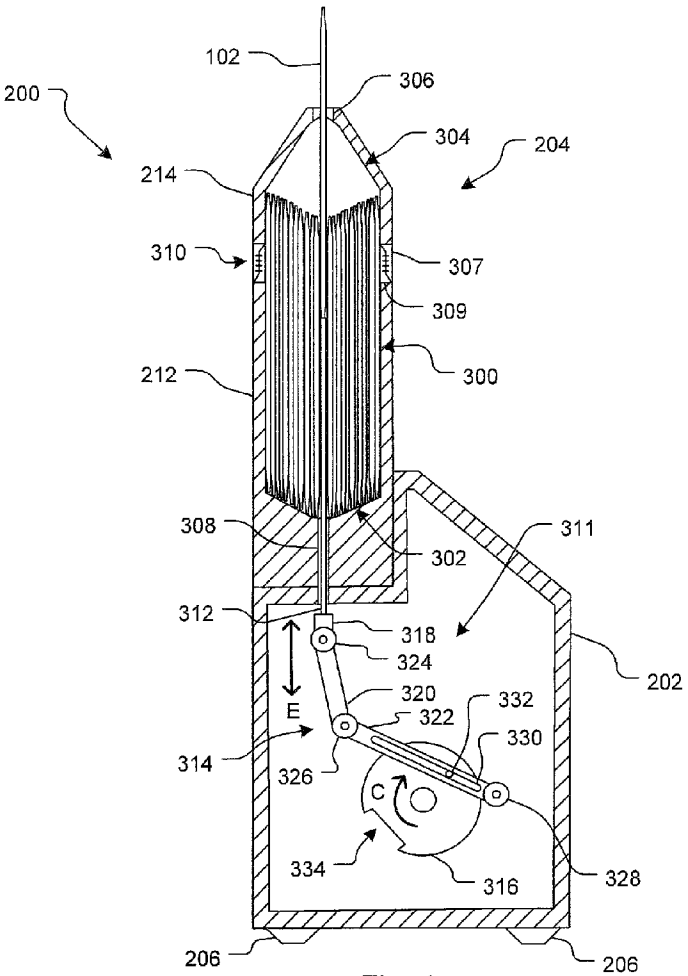
FIG. 4 is a longitudinal cross-sectional view of the toothpick dispenser of FIG. 2 shown in an extended mode.
Figure 3:
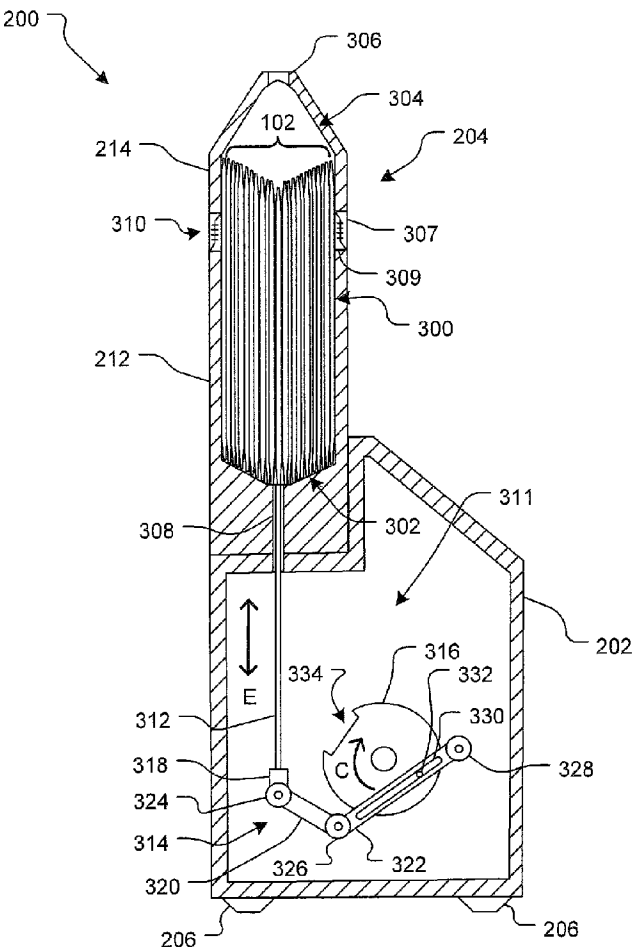
FIG. 3 is a longitudinal cross-sectional view of the toothpick dispenser of FIG. 2 shown in a retracted mode.

Referring now also to FIGS. 3 and 4 in the drawings, dispenser 200 is shown in longitudinal cross-section views. FIG. 3 depicts dispenser 200 in the retracted mode, and FIG. 4 depicts dispenser 200 in the extended mode. As is shown, chamber 204 includes an inner surface 300, a bottom surface 302, and an upper surface 304. An upper aperture 306 passes through upper surface 304. A lower aperture 308 passes through bottom surface 302. Upper chamber portion 214 is preferably coupled to lower chamber portion 212 by a releasable fastening means 310 to facilitate restocking of toothpicks 102 in chamber 204. In the preferred embodiment, releasable fastening means 310 is a threaded coupling 307, 309; however, it will be appreciated that releasable fastening means may be a clip, clamp, quick-release, or any other suitable fastening means. it is also preferred that bottom surface 302 be configured to taper downwardly and inwardly toward lower aperture 308. This causes toothpicks 102 to gravitate toward the center of chamber 204 and toward lower aperture 308. Upper surface 304 is configured to taper upwardly and inwardly toward the center of chamber 204 and toward upper aperture 306. This causes the single toothpick 102 to move toward the center of chamber 204 and toward upper aperture 306 as the single toothpick 102 is extracted.

Dispenser 200 includes a lift system 311 for extracting a single toothpick 102 out from chamber 204 in response to activation of sensor 208. Lift system 311 includes an extraction rod 312 coupled to a link system 314. Link system 314 preferably includes links 318, 320, and 322, which are pivotally coupled together at pivot joints 324 and 326. Link 322 is pivotally coupled at a pivot joint 328 to a support member 742 (see FIG. 7), which is rigidly attached to housing 202. As shown in FIG. 4, extraction rod 312 slidingly passes through lower aperture 308 for elevating a single toothpick 102 through channel 306. Extraction rod 312 is coupled to a dispenser cam 316 via link system 314, such that rotation of dispenser cam 316 in a direction indicated by arrow C causes extraction rod 312 to translate relative to lower aperture 308 in a direction indicated by arrow E. Link 322 includes an elongated slot 330 for receiving a guide pin 332 that is eccentrically attached to dispenser cam 316. This configuration causes link 322 to pivot about pivot joint 328 in response to rotation of dispenser cam 316.

Figure 5:
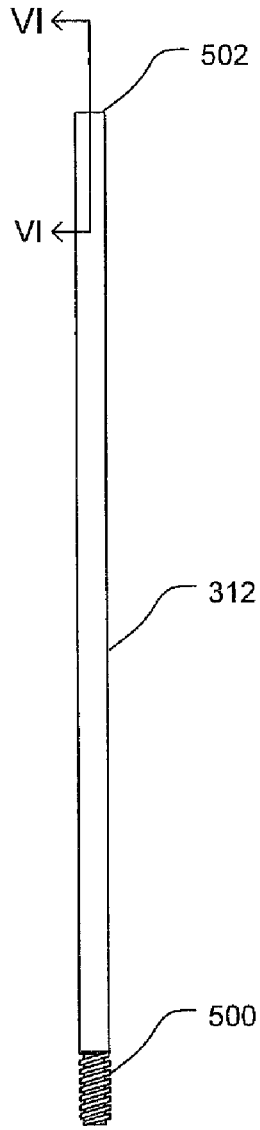
FIG. 5 is an enlarged side view of a rod of the toothpick dispenser of FIG. 2.
Figure 6:
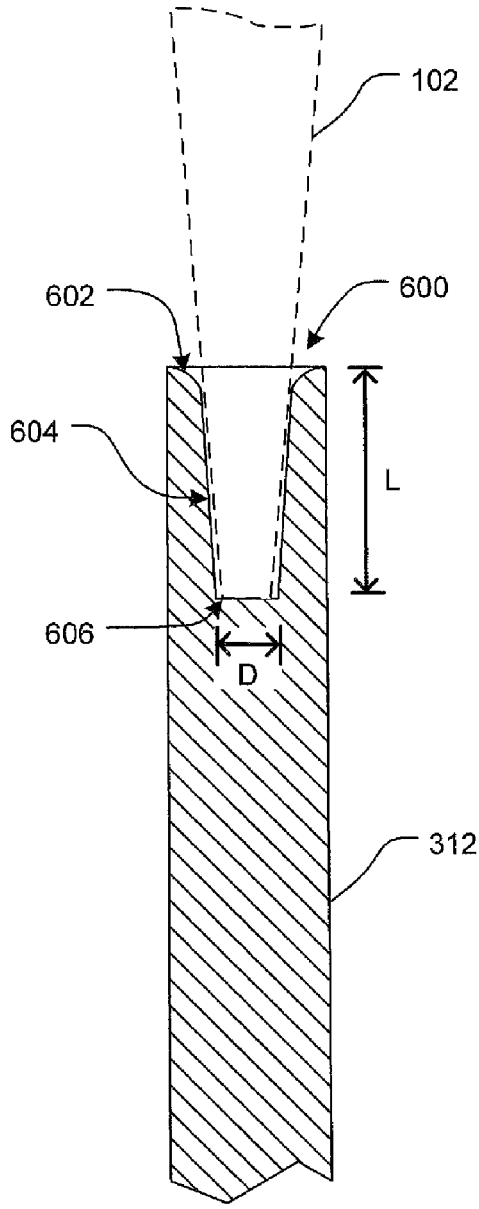
FIG. 6 is a cross-sectional view of the rod of FIG. 5 taken at VI-VI.

Referring now also to FIGS. 5 and 6 in the drawings, enlarged views of extraction rod 312 are shown. FIG. 5 is a side view of extraction rod 312, and FIG. 6 is a cross-sectional view of extraction rod 312 taken at VI-VI of FIG. 5. As shown in FIG. 5, rod 312 includes a lower end 500 and an upper end 502. Lower end 500 is adapted for releasable attachment to link 318, preferably by a threaded coupling, as shown in FIG. 5. In an alternative embodiment, extraction rod 312 is integrally formed with link 318. Upper end 502 is configured with a bore 600 for receiving the lower end of a single toothpick 102. As shown in FIG. 6, bore 600 is preferably frusto-conical in shape, having a curved upper surface 602, inwardly sloping side walls 604, and a flat bottom surface 606. This configuration ensures that a single toothpick 102 enters bore 600 as extraction rod 312 is pushed upward. Bore 600 has a depth L and a bottom diameter D. In the preferred embodiment, L is approximately 0.05 inches and D is approximately 0.028 inches. This configuration creates close tolerances between toothpicks 102 and slot 600, thereby restricting movement of toothpick 102 relative to upper end 502 as extraction rod 312 elevates toothpick 102 during dispensing mode. It will be appreciated that a wide range of lengths L and diameter D may be used to facilitate use with toothpicks of varying shapes and sizes. It is preferred that in the retracted mode, upper end 502 is retracted to a position substantially level or just below bottom surface 302. This ensures that a single toothpick 102 will fall into bore 600 during the retracted mode.

Figure 7:
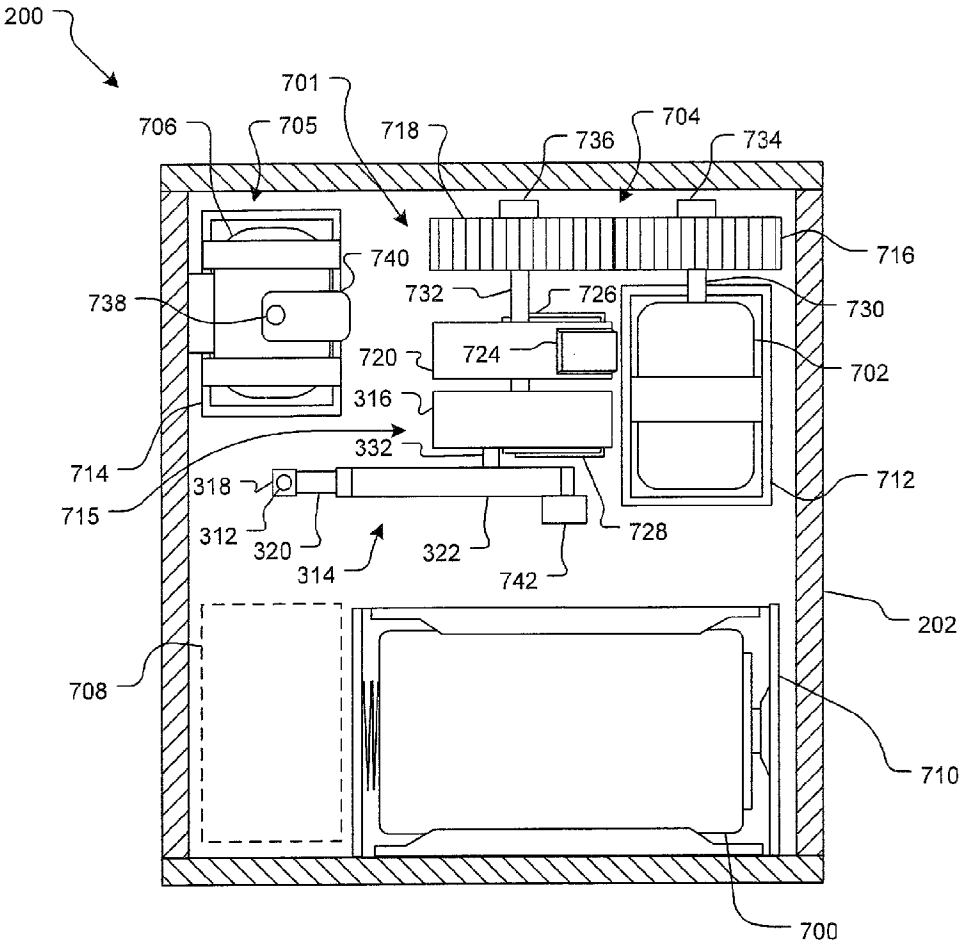
FIG. 7 is a transverse cross-sectional view of the toothpick dispenser of FIG. 2.

Referring now also to FIG. 7 in the drawings, dispenser 200 is shown in a transverse cross-section view. As is shown, housing 202 carries electrical power source 700, a drive system 701, a switch system 715, a shaker system 705, and optional recharging system 708. In the preferred embodiment, electrical power source 700 is one or more DC batteries. Drive system 701 includes one more drive mechanisms, including a dispenser motor 702, a gear system 704, and link system 314. Mounting brackets 710, 712, and 714 support electrical power source 700, motor 702, and motor 706, respectively. In the preferred embodiment, gear system 704 includes a driving gear 716 and a driven gear 718. Driving gear 716 is coupled to dispenser motor 702 via a shaft 730. Dispenser cam 316 and shaker cam 720 are rotatably carried by a shaft 732 coupled to driven gear 718. Shafts 730 and 732, driving gear 716, and driven gear 718 are supported by support members 734 and 736, respectively. Switch system 715 includes dispenser cam 316 having a recessed notch 334, a dispenser switch 728, a shaker cam 720 having an upraised portion 724, and a shaker switch 726. Upraised portion 724 and recessed notch 334 are operably associated with shaker switch 726 and dispenser switch 728, respectively.

A weight 740 is eccentrically coupled to a shaft 738 of shaker motor 706. In addition, shaker motor 706 is coupled to chamber 204, such that activation of shaker motor 706 and weight 740 causes chamber 204 to vibrate. The vibrations imparted to chamber 204 from shaker motor 706 cause toothpicks 102 to reposition within chamber 204 by sliding down surface 302 into slot 600.

Figure 8:
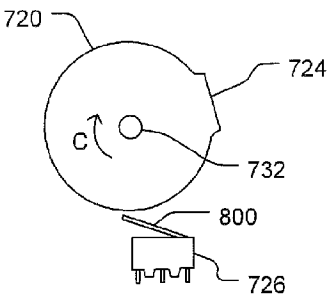
FIG. 8 is a schematic of a shaker cam of the toothpick dispenser of FIG. 2.
Figure 9:
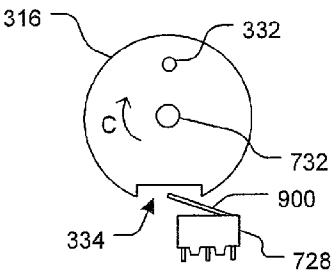
FIG. 9 is a schematic of a dispenser cam of the toothpick dispenser of FIG. 2.

Referring now also to FIGS. 8 and 9 in the drawings, the operation of dispenser cam 316 and shaker cam 720 are illustrated. In the preferred embodiment, dispenser cam 316 and shaker cam 720 are configured, dimensioned, and oriented relative to each other, such that dispenser switch 728 and shaker switch 726 are selectively aligned, thereby activating at selected timing intervals. As is shown, both dispenser cam 316 and shaker cam 720 are simultaneously driven by shaft 732 and rotate at the same rotational velocity. As shown in FIG. 8, shaker switch 726 includes a switch lever 800. When upraised portion 724 engages switch lever 800, an electrical circuit is completed, thereby activating shaker motor 706. As shown in FIG. 9, dispenser switch 728 includes a switch lever 900. When switch lever 900 encounters recessed portion 334, an electrical circuit is opened, thereby deactivating dispenser motor 702. It will be appreciated that in alternative embodiments, other types of systems and components could be used in lieu of cams, gears, and linkages. For example, an electrical relay and timer could activate and deactivate dispenser motor 702 and shaker motor 706, or a piezoelectric telescoping actuator could be used in lieu of extraction rod 312.

Figure 10:
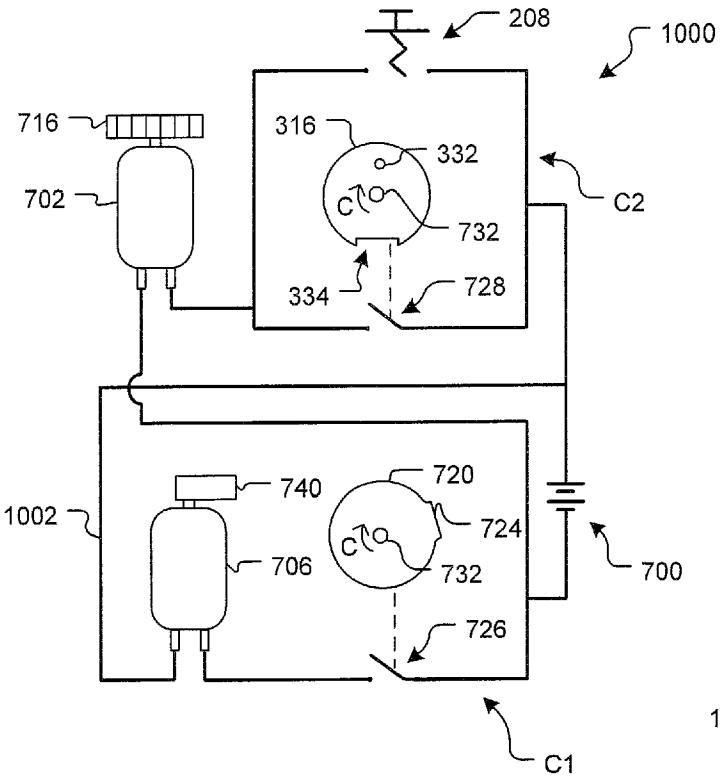

Referring now also to FIG. 10 in the drawings, a simplified schematic diagram of an electrical system 1000 for dispenser 200 is illustrated. Electrical system 1000 includes dispenser motor 702, dispenser switch 726, shaker motor 706, shaker switch 728, dispenser cam 316, and shaker cam 720, sensor 208, and power source 700. As is shown, the components of electrical system 100 are conductively coupled together via a plurality of conductors 1002. In the interest of clarity, only one conductor 1002 is labeled. Electrical system 1000 includes two circuits C1 and C2. Circuit C1 includes shaker switch 728, shaker motor 702, and power source 700. Circuit C2 includes sensor 208, power source 700, dispenser switch 726, and dispenser motor 702. As shown in FIG. 10, circuits C1 and C2 are open, i.e., dispenser motor 702 and shaker motor 706 are not provided electrical current from power device source 700. When circuits C1 and C2 are closed, dispenser motor 702 and shaker motor 706 are activated, i.e., provided electrical current from power source 700.

Upon detection of the user, sensor 208 closes circuit C2, thereby providing electrical current from power source 700 to dispenser motor 702. Dispenser motor 702 rotates gear 716, which in turn rotates dispenser cam 316 and shaker cam 720. During this time, dispenser cam 316 pivots link system 314, which elevates and retracts extraction rod 312. Dispenser motor 702 remains activated until switch lever 900 of dispenser switch 728 encounters recessed portion 334. After a short duration of time, sensor 208 resets and reopens circuit C2. Circuit C1 remains open until upraised portion 724 comes into contact with switch lever 800 of shaker switch 726. Electrical power is provided to the shaker motor 706 when circuit C1 closes. Shaker motor 706 rotates weight 740, which causes vibrations within chamber 204 for repositioning toothpicks 102. This allows extraction rod 312 to receive a single toothpick 102 and push that toothpick 102 at least partially through aperture 306 in upper portion 304 of chamber 204, where toothpick 102 may be easily grasped and taken by the user without contamination of the other toothpicks 102 within chamber 204.

Figure 11:
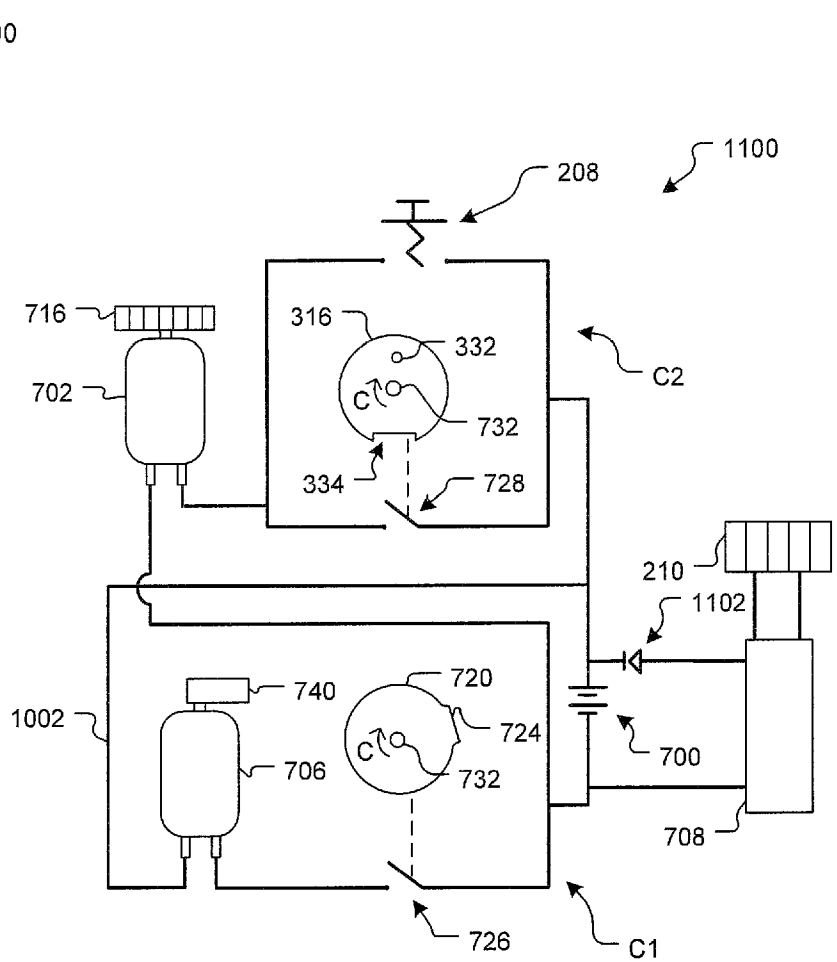
FIGS. 10 and 11 are schematic diagrams of electrical and mechanical components of the dispenser of FIG. 2.

Referring now to FIG. 11 in the drawings, an alternative electrical system 1100 for dispenser 200 is illustrated. Electrical system 1100 is substantially similar in form and function to electrical system 1000; however, electrical system 1100 includes optional recharging system 708 and solar collector 210 for recharging power source 700, which in this embodiment, is a rechargeable electrical power source, such as rechargeable batteries. Electrical system 1100 includes a diode 1102 that prevents electrical current from returning to recharging system 708.

It should be understood that other configurations for dispenser 200 may be utilized without departing from the scope of the present application. For example, although chamber 204 has been shown in a generally vertical orientation, chamber 204 may be oriented in a more horizontal orientation. In such an embodiment, the walls of chamber 204 may be configured in a different manner, such as V-shaped, to allow a single toothpick to be dispensed during operation.

It is evident by the foregoing description that the sanitary automated toothpick dispenser of the subject application has significant benefits and advantages over known dispensers, including: (1) it provides means wherein a user may retrieve a toothpick without being exposed to germs from other users; and (2) it eliminates the need for toothpicks to be individually wrapped.

The particular embodiments disclosed above are illustrative only, as the invention may be modified and practiced in different but equivalent manners apparent to those skilled in the art having the benefit of the teachings herein. It is therefore evident that the particular embodiments disclosed above may be altered or modified, and all such variations are considered within the scope and spirit of the invention. Accordingly, the protection sought herein is as set forth in the description. Although the present invention is shown in a limited number of forms, it is not limited to just these forms, but is amenable to various changes and modifications without departing from the spirit thereof.

What is claimed is:

1. A toothpick dispenser, comprising:

a chamber for holding a plurality of toothpicks, the chamber having an aperture through which a single toothpick is dispensed;

a lift system associated with the chamber, the lift system being configured to dispense the single toothpick to a taking position such that a user is provided access to the single toothpick without coming into contact with the remaining plurality of toothpicks placed within the chamber;

a sensor operably associated with the lift system, the sensor being configured to activate the lift system upon detection of the user;

a drive system operably associated with the sensor and the lift system, the drive system being configured to activate the lift system upon detection of the user;

a shaker system operably associated with the drive system, the shaker system being configured to shake the chamber;

a dispenser cam driven by the drive system and operably associated with the lift system, the dispenser cam being configured to activate the lift system; and a shaker cam driver by the drive system and operably associated with the shaker system, the shaker cam being configured to activate the shaker system.

2. The dispenser of claim 1, wherein the shaker system is activated for a selected time period after the lifting system has dispensed the single toothpick.

3. The dispenser of claim 1, the shaker system comprising:

a shaker motor; and a weight coupled to the shaker motor;

wherein rotation of the weight causes shaking of the chamber.

4. The dispenser of claim 1, wherein the sensor is a motion detector.

5. The dispenser of claim 1, wherein the sensor is a proximity sensor.

6. The dispenser of claim 1, wherein the shaker cam activates the shaker system for a selected time after activation of the lifting system by the dispenser cam.

7. A toothpick dispenser, comprising:

a chamber for holding a plurality of toothpicks, the chamber having an aperture through which a single toothpick is dispensed;

a lift system associated with the chamber, the lift system being configured to dispense the single toothpick to a taking position such that a user is provided access to the single toothpick without coming into contact with the remaining plurality of toothpicks placed within the chamber; and a drive system operably associated with the lift system, the drive system being configured to activate the lift system, the drive system having:

a dispenser cam driven by the drive system and operably associated with the lift system, the dispenser cam being configured to activate the lift system, the dispenser having:

a guide pin protruding from a surface of the dispenser cam; and a link system operably associated with the dispenser cam and the lift system, the link system having:

a link having a elongated slot configured to receive the guide pin;

wherein rotation of the of the dispenser cam causes the guide pin to slide within the elongated slot, which in turn causes the lift system to dispense the single toothpick via the link.

8. The dispenser of claim 7, further comprising:

a shaker system operably associated with the drive system, the shaker system being configured to shake the chamber.

9. The dispenser of claim 8, the shaker system comprising:

a shaker motor; and a weight coupled to the shaker motor;

wherein rotation of the weight causes shaking of the chamber.

10. The dispenser of claim 8, the shaker system having:

a shaker cam driver by the drive system and operably associated with the shaker system, the shaker cam being configured to activate the shaker system.

11. The dispenser of claim 10, further comprising:

a dispensing switch operably associated with the dispenser cam for controlling the dispenser motor; and a shaker switch operably associated with the shaker cam for controlling the shaker motor.

12. The dispenser of claim 11, wherein the timing of the dispensing switch and the shaker switch are selectively set, such that the shaker cam is activated for a selected time period after the dispenser cam has been activated.

13. The dispenser of claim 7, further comprising:

a sensor operably associated with the drive system, the sensor being configured to activate the drive system upon detection of the user.

14. A method to dispense toothpicks, comprising:

placing a plurality of toothpicks within a chamber;

detecting the presence of a user with a sensor operably associated with a lift system;

activating a lift system upon detection of the user;

dispensing a single toothpick of the plurality of toothpick with the lift system; and shaking the chamber with a shaking system upon detection of the user;

wherein the single toothpick is dispensed to a taking position such that the user is provided access to the single toothpick without coming into contact with the remaining plurality of toothpicks placed within the chamber.

15. The method of claim 14, further comprising:

driving the lift system with a driver system; and powering the driver system with a power source.

* * * * *